US006638042B1

(12) United States Patent
Holden

(10) Patent No.: US 6,638,042 B1
(45) Date of Patent: Oct. 28, 2003

(54) ASYMMETRIC PORTING FOR MULTI-ROTOR SCREW COMPRESSOR

(75) Inventor: Steven James Holden, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/142,679

(22) Filed: May 8, 2002

(51) Int. Cl.[7] ..... F01C 18/00
(52) U.S. Cl. ..... 418/197; 418/15; 418/201.2
(58) Field of Search ..... 418/197, 15, 201.2

(56) References Cited

U.S. PATENT DOCUMENTS 2,481,527 A * 9/1949 Nilsson ..... 418/197
3,574,488 A * 4/1971 Vanderstegen-Drake .... 418/197
4,573,324 A * 3/1986 Tischer et al. ..... 418/97
4,776,779 A * 10/1988 Crump ..... 418/197
5,775,117 A * 7/1998 Shaw ..... 418/201.2

* cited by examiner

*Primary Examiner*—Thomas Denion
*Assistant Examiner*—Theresa Trieu
(74) *Attorney, Agent, or Firm*—Bachman & LaPointe

(57) ABSTRACT

A screw compressor includes a compressor housing defining parallel rotor housing sections, each rotor housing section containing a rotor, and adjacent rotors defining compressor pairs, the housing further including a suction port and a discharge port for each of the compressor pairs, and further including additional ports selected from first closed lobe ports, last closed lobe ports, and economizer ports, wherein at least one of the additional ports is communicated with a first pair of the at least two pairs, and another of the additional ports is communicated with a second pair of the at least two pairs whereby interaction between the additional ports is reduced. In accordance with a further aspect of the invention, configurations are provided so that the first discharge port has a lower volume index ratio ($V_i$) than the second discharge port.

5 Claims, 2 Drawing Sheets

ASYMMETRIC PORTING FOR MULTI-ROTOR SCREW COMPRESSOR

BACKGROUND OF THE INVENTION

The present invention relates to multi-rotor screw compressors and, more particularly, to improved porting configurations for same.

Twin screw compressors are known, and typically relate to a compressor having a housing defining rotating chambers for two rotors, and such compressors typically have a number of various ports. The primary ports are suction and discharge ports, and additional ports which are typically utilized in screw compressors include a first closed lobe (FCL) port, a last closed lobe (LCL) port, economizer ports and other pressure-balancing ports. Each of these ports performs a different system function in connection with compressor operation.

Multi-rotor screw compressors are known and have housings defining more than two rotor chambers, with three or more rotors defining at least two parallel pairs, each of which can act as an independent compressor pair. Providing the various ports as outlined above for such a compressor can cause difficulty because, depending upon compressor design details and system operating conditions, the various ports can interact with each other. This interaction can substantially interfere with efficient operation of the compressor.

Based upon the foregoing, it is clear that the need remains for improved housing and porting structures for multi-rotor screw compressors.

It is therefore the primary object of the present invention to provide improved housing and porting structures for such compressors, whereby the compressor can operate more efficiently.

It is a further object of the present invention to provide such porting for a multi-rotor screw compressor which reduces noise of operation as well.

Other objects and advantages of the present invention will appear hereinbelow.

SUMMARY OF THE INVENTION

In accordance with the present invention, the foregoing objects and advantages have been readily attained.

According the invention, a multi-rotor screw compressor is provided, which comprises a compressor housing defining at least three parallel rotor housing sections, each rotor housing section containing a rotor, and adjacent rotors defining at least two compressor pairs, said housing further including a suction port and a discharge port for each of said compressor pairs, and further comprising at least two additional ports selected from the group consisting of first closed lobe ports, last closed lobe ports, and economizer ports, wherein at least one of said additional ports is communicated with a first pair of said at least two pairs, and another of said additional ports is communicated with a second pair of said at least two pairs whereby interaction between said additional ports is reduced.

In further accordance with the present invention, only a single pair of the multiple pairs of the screw compressor is provided with an economizer port, and the discharge ports for the multiple pairs are selectively sized so as to provide the economized pair with a lower volume index ratio than the non-economized pair. This helps provide for efficient compressor operation and also reduces noise due to pressure pulsation and the like.

Asymmetrical distribution of ports in accordance with the present invention can advantageously be utilized to provide for efficient operation of the multi-rotor screw compressor, while also avoiding interaction between ports so as to improve overall performance of same.

BRIEF DESCRIPTION OF THE DRAWINGS

A detailed description of preferred embodiments of the present invention follows, with reference to the attached drawings, wherein.

DETAILED DESCRIPTION

The invention relates to multi-rotor screw compressors and, more particularly to configuration of housing and porting structures for same so as to enhance operating efficiency and reduce operating noise of the compressor.

As set forth above, screw compressors typically have suction and discharge ports for incoming and outgoing fluid, and further have additional ports of various types, including economizer ports, last closed lobe (LCL) ports, first closed lobe (FCL) ports, pressure balancing ports and the like. In conventional twin screw compressors, these ports are positioned at various locations communicating with the screw pair for enhancing operation of the compressor.

In multi-rotor screw compressors, that is, screw compressors having three or more rotors, it has been found that enhanced operation can be provided by positioning the additional ports, and/or configuring the port structure, in an asymmetric fashion as between the multiple pairs of adjacent and parallel rotors, and that this positioning of porting and configuration of same advantageously can be adapted to avoid undesirable communication between ports. This structure can further be adapted to uniquely optimize the volume index ratio ($V_i$) for each pair, and for male and female compression pockets along the pair, so as to enhance compressor efficiency, reduce noise, and provide for an overall more reliable device.

In accordance with the invention, although each pair must have a suction port and a discharge port, the remaining ports can advantageously be divided between the pairs of the multi-rotor screw compressor so as to advantageously position these ports in positions where they will operate efficiently to provide the desired result without interfering with each other.

Figure 1:
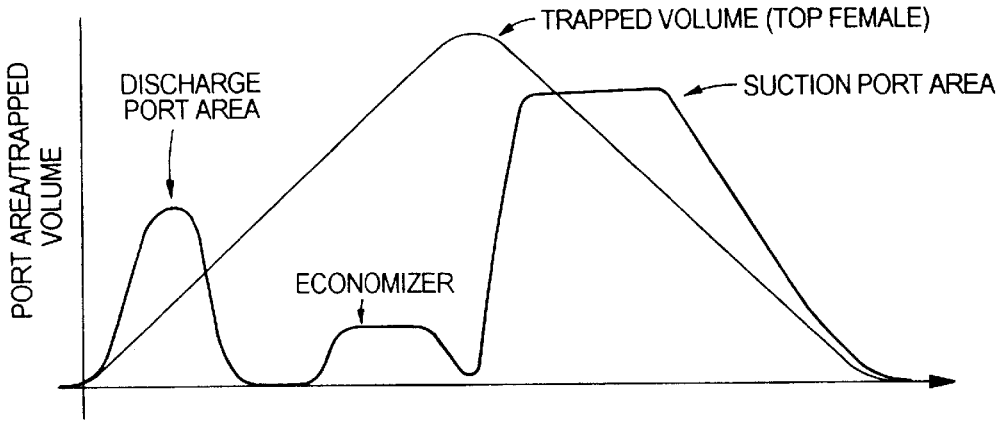
FIG. 1 shows trapped volume as well as suction, discharge and economizer port area for the top female screw of a multi-rotor screw compressor as a function of male beta angle.
Figure 2:
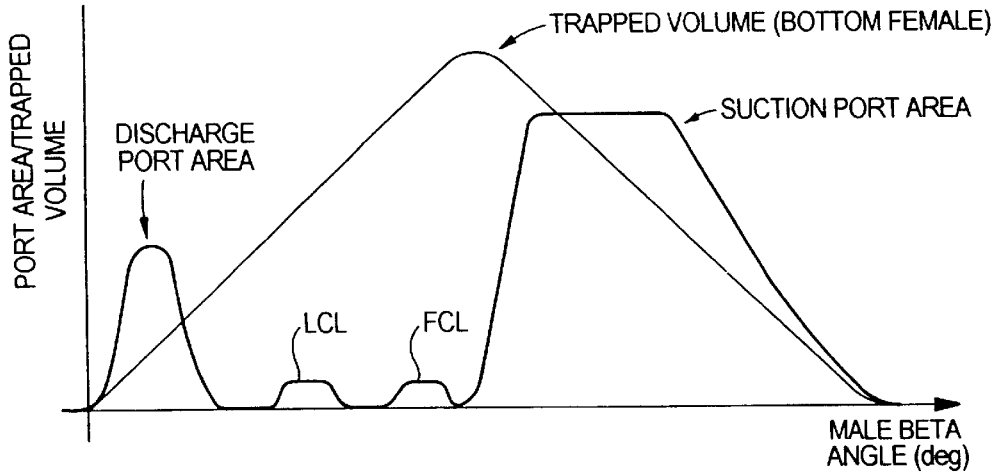
FIG. 2 illustrates trapped volume as well as suction port area, LCL port area, FCL port area, and discharge port area for the bottom female rotor of a multi-rotor screw compressor as a function of male beta angle.
Figure 3:
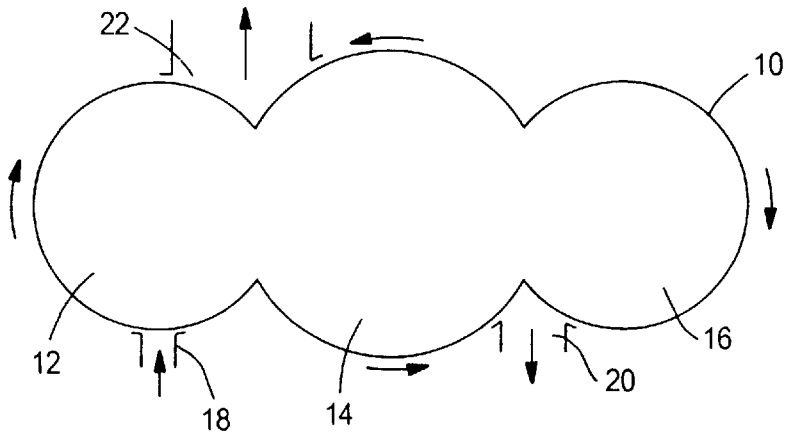
FIG. 3 schematically illustrates the housing portion of a multi-rotor screw compressor, and positioning of economizer and discharge ports on same.

FIGS. 1 and 2 graphically illustrate the trapped volume and port area for the female compressors of a multi-rotor screw compressor such as that partially schematically illustrated in FIG. 3.

FIG. 1 therefore corresponds to the configuration of a first pair, formed by a first female rotor and the male rotor, and FIG. 2 corresponds to a second pair, formed by the second female rotor and the male rotor.

FIG. 1 shows that the first pair includes a suction port and a discharge port, and shows the port area for same, and also includes an economizer port positioned therebetween and communicated with this pair at a position along the male beta or crank angle.

FIG. 2 shows the second pair, and this pair also has a suction port and discharge port as illustrated by the corresponding suction port and discharge port areas of FIG. 2, and further has last closed lobe (LCL) and first closed lobe (FCL) ports as schematically illustrated. This pair is not directly communicated with the economizer port of the first pair. Thus, FIGS. 1 and 2 illustrate the port area or trapped volume for a three-rotor screw compressor wherein a first pair is provided with suction and discharge ports, as is a second pair, and that additional ports including an economizer port, a last closed lobe port and a first closed lobe port are distributed between the two pairs in asymmetric fashion. In this manner, the economizer port can provide for enhanced operation of the first pair, without interfering with or communicating with the last closed lobe and first closed lobe ports of the second pair, as is desired in accordance with the present invention.

FIGS. 1 and 2 further schematically illustrate an asymmetric configuration of the discharge port area for the first and second pairs. FIG. 1 shows a greater discharge port area than FIG. 2, and a discharge port which opens sooner than that of FIG. 2. This results in a lower volume index ratio for the pair of FIG. 1 than the pair of FIG. 2, and this is desirable, in accordance with the present invention, since FIG. 1 is the pair that includes an economizer port.

FIG. 3 further illustrates this aspect of the present invention, and shows a multi-rotor screw compressor housing 10 which defines three parallel rotor housing sections 12, 14, 16, each of which would contain a rotor (not shown). Typically, housing sections 12, 16 would each rotatably house a female rotor, and housing section 14 would house a male rotor. Adjacent rotors functionally engage each other and define a compressor pair. Thus, in the embodiment of FIG. 3, rotors in housing sections 12 and 14 would define a first compressor pair, and rotors in housing sections 14 and 16 would define a second compressor pair. FIG. 3 shows the first pair having an economizer port 18 which serves to introduce fluid at a mid-range pressure back into the compression cycle. FIG. 3 also shows discharge ports 20, 22, associated with each pair of the compressor. As was also schematically illustrated in FIGS. 1 and 2, the multi-rotor screw compressor in accordance with the present invention has a larger discharge port 22 on the pair which includes economizer port 18, and a smaller discharge port 20, as compared to discharge port 22, on the pair which does not include economizer port 18. As set forth above, this advantageously serves to eliminate over-compression of the economized pair, and thereby reduce discharge noise and pressure pulsation which could otherwise occur. In this manner, each pair can be optimized independently for the same working condition, each of which can be selected so as to meet the desired output of the compressor.

It should be appreciated that each of the types of configurations of multi-rotor screw compressor housing and porting structures as described above can be used, separately or in combination, so as to optimize the operating efficiency of the screw compressor, balance $V_i$ conditions in various locations of the compressor, and avoid interference or communication between various ports. The end result is a more efficient compressor, which also operates more quietly, and which is less likely to operate under conditions where compressor damage can result.

Although this disclosure is made in terms of a three-rotor compressor, in this case a single male rotor with two female rotors, other multi-rotor configurations are possible, and the teachings of the present invention would be readily applicable to same.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A multi-rotor screw compressor, comprising:

a compressor housing defining at least three parallel rotor housing sections, each rotor housing section containing a rotor, and adjacent rotors defining at least two compressor pairs, said housing further including a suction port and a discharge port for each of said compressor pairs, and further comprising at least two different additional ports selected from the group consisting of first closed lobe ports, last closed lobe ports, and economizer ports, wherein at least one of said additional ports is communicated with a first pair of said at least two pairs, and another of said additional ports is communicated with a second pair of said at least two pairs whereby interaction between said additional ports is reduced.

2. A multi-rotor screw compressor, comprising:

a compressor housing defining at least three parallel rotor housing sections, each rotor housing section containing a rotor, and adjacent rotors defining at least two compressor pairs, said housing further including a suction port and a discharge port for each of said compressor pairs, and further comprising at least two additional ports selected from the group consisting of first closed lobe ports, last closed lobe ports, and economizer ports, wherein at least one of said additional ports is communicated with a first pair of said at least two pairs, and another of said additional ports is communicated with a second pair of said at least two pairs whereby interaction between said additional ports is reduced, wherein said first pair is communicated with said economizer port and has a first discharge port, and wherein said second pair is not communicated with said economizer port and has a second discharge port, and wherein said first discharge port and said second discharge port are selectively sized so as to provide said first discharge port with a lower volume index ratio ($V_i$) than said second discharge port.

3. A multi-rotor screw compressor, comprising:

a compressor housing defining at least three parallel rotor housing sections, each rotor housing section containing a rotor, and adjacent rotors defining at least two compressor pairs, said housing further including a suction port and a discharge port for each of said compressor pairs, and further comprising at least two different additional ports selected from the group consisting of first closed lobe ports, last closed lobe ports, and economizer ports, wherein said at least two different additional ports are asymmetrically distributed between said compressor pairs.

4. A multi-rotor screw compressor, comprising:

a compressor housing defining at least three parallel rotor housing sections, each rotor housing section containing a rotor, and adjacent rotors defining at least two compressor pairs, said housing further including a suction port and a discharge port for each of said compressor pairs, and further comprising at least two additional ports selected from the group consisting of first closed lobe ports, last closed lobe ports, and economizer ports, wherein said at least two additional ports are asymmetrically distributed between said compressor pairs, wherein a first pair of said compressor pairs is communicated with said economizer port and has a first discharge port, and wherein a second pair of said compressor pairs is not communicated with said economizer port and has a second discharge port, and wherein said first discharge port and said second discharge port are selectively sized so as to provide said first discharge port with a lower volume index ratio ($V_i$) than said second discharge port.

5. A multi-rotor screw compressor, comprising:

a compressor housing defining at least three parallel rotor housing sections, each rotor housing section containing a rotor, and adjacent rotors defining at least two compressor pairs, wherein a first pair of said at least two compressor pairs is communicated with an economizer port and has a first discharge port, and wherein a second pair of said at least two compressor pairs is not communicated with said economizer port and has a second discharge port, and wherein said first discharge port and said second discharge port are selectively sized so as to provide said first discharge port with a lower volume index ratio ($V_i$) than said second discharge port.

* * * * *